US005966968A

United States Patent [19]

Lonati et al.

[11] Patent Number: 5,966,968

[45] Date of Patent: Oct. 19, 1999

[54] SINGLE-CYLINDER CIRCULAR KNITTING MACHINE WITH DEVICE FOR ACTUATING THE CUTTER MOUNTED ON THE DIAL

[75] Inventors: Francesco Lonati; Ettore Lonati; Fausto Lonati; Tiberio Lonati, all of Brescia, Italy

[73] Assignee: Lonati S.p.A., Monza, Italy

[21] Appl. No.: 09/112,297

[22] Filed: Jul. 9, 1998

[30] Foreign Application Priority Data

Jul. 22, 1997 [IT] Italy ..... MI97A1733

[51] Int. Cl.[6] ..... D04B 15/61

[52] U.S. Cl. ..... 66/145 R; 66/140 R

[58] Field of Search ..... 66/140 S, 145 R, 66/145 S, 134, 8, 140 R

[56] References Cited

U.S. PATENT DOCUMENTS 2,952,148 9/1960 Rather ..... 66/145 R
3,252,307 5/1966 Kaese ..... 66/145 R
3,283,544 11/1966 Kent ..... 66/140 S
3,488,679 1/1970 Boy ..... 66/134
3,496,738 2/1970 Conti ..... 66/140 S

*Primary Examiner*—Andy Falik
*Attorney, Agent, or Firm*—Guido Modiano; Albert Josif

[57] ABSTRACT

A single-cylinder circular machine for knitting, hosiery or the like, with a device for actuating the cutter mounted on the dial comprises: a needle cylinder, which can be rotationally actuated about its own axis; a dial, which is arranged above the needle cylinder and is supported so that it can rotate about its own axis; and a cutter for cutting the yarns, which is mounted coaxially on the dial and is provided with cutting teeth arranged around its own axis. The machine has a device which comprises an actuation for the cutter with a rotary motion about its own axis with a rotation rate which can be diversified from the rotation rate of the needle cylinder, in order to vary the length of the trailing portion of yarn that lies between the last needle of the machine taking up the yarn and the blade cooperating with the cutter in cutting the yarn.

16 Claims, 2 Drawing Sheets

1
2
2a
3
3a
4
4a
5
6
7
8
9
10
11
12
13
14
20
21
22
23
24
25
26
30
31
33
40
42
44
50
50a
51

SINGLE-CYLINDER CIRCULAR KNITTING MACHINE WITH DEVICE FOR ACTUATING THE CUTTER MOUNTED ON THE DIAL

BACKGROUND OF THE INVENTION

The present invention relates to a single-cylinder circular machine for knitting, hosiery or the like, with a device for actuating the cutter mounted on the dial.

Conventional single-cylinder circular machines for knitting or hosiery are composed of a needle cylinder which has a vertical axis and can be rotated about said axis and a dial which is arranged above and coaxially to the needle cylinder.

Hooks are usually arranged in the dial and can be actuated in a radial direction with respect to the dial axis in order to cooperate with the needles when forming particular kinds of knitting, such as for example the formation of a tubular border at one end of the item being formed.

The dial is usually equipped with a circular cutter which is arranged coaxially to the dial and has a plurality of teeth protruding radially. Said cutter is usually rigidly coupled to the dial, which is supported, so that it can rotate about its own axis, by an adapted frame arranged above the needle cylinder. On said frame, proximate to the cutter, there are one or more blades which rest on the upper face of the cutter proximate to the region of the teeth in order to cooperate with them in cutting the yarn.

Cutting the yarn becomes necessary at the end of a step in which the machine has knitted with a given yarn, or during the formation of patterns with yarns of different colors on the item. In this situation the yarns, at the end of the portion of the row of knitting to be formed with said yarns, are placed beyond the reach of the needles of the machine and are cut by means of the cutter and the blade. In practice, in order to cut the yarn, the yarn finger that dispenses it is moved into a position where it cannot be engaged by the needles of the machine and the yarn, which has remained hooked to the last needle of the machine that has taken it up, is stretched between said needle and the corresponding yarn finger and is engaged by the cutter, which rotates together with the needle cylinder and the dial. When the yarn thus engaged arrives at the cutter, it is cut.

Depending on the kind of weaving operation used to knit these yarns which are then cut, it is necessary to cut the yarn so as to leave a trailing portion which is sufficient to safely prevent said yarn from laddering. Accordingly, depending on the kind of weaving operation used to knit the yarns which are then cut, it is necessary to be able to vary the length of the trailing portion of yarn, i.e., of the part of yarn that usually remains on the reverse side of the item. A short length is undesirable because said yarn might ladder during the life of the item, while an excessive length is undesirable due to aesthetic reasons and for the convenience of the user and can cause yarns of nearby patterns to overlap.

With currently commercially available machines with the circular cutter coaxially fixed to the dial, the length of the trailing portion of the yarn can be changed only by varying the number of teeth of the cutter, in which the varying spacing between the varying number of teeth peripherally spaced about the axis of the cutter and dial determines the trailing yarn length. In practice, when a longer trailing portion of yarn is to be obtained, cutters having a reduced number of teeth and thus an increased tooth spacing are used, while when a shorter length is to be obtained, cutters having a greater number of teeth and thus a decreased tooth spacing are used.

Since in order to vary the length of the trailing portion of yarn it is necessary to replace the cutter, with currently commercially available machines it is practically impossible to change the length of the trailing portion of the yarns cut on a same item.

SUMMARY OF THE INVENTION

The aim of the present invention is to solve the above problem by providing a single-cylinder circular machine for knitting, hosiery or the like, provided with a device for actuating the cutter mounted on the dial which allows to vary, according to the requirements, the length of the trailing portion of the yarns that are cut.

Within the scope of this aim, an object of the invention is to provide a machine with a device which, during the production of a same item, allows to vary from region to region the length of the trailing portion of the yarns being cut.

Another object of the invention is to provide a device for actuating the cutter mounted on the dial which offers adequate assurances of safety and reliability in operation.

Another object of the invention is to provide a device for actuating the cutter mounted on the dial which can be installed in a wide range of single-cylinder circular machines for knitting, hosiery or the like.

This aim, these objects and others which will become apparent hereinafter are achieved by a single-cylinder circular machine for knitting, hosiery or the like, with a device for actuating the cutter mounted on the dial, comprising: a needle cylinder, which can be rotationally actuated about its own axis; a dial, which is arranged above the needle cylinder and is supported so that it can rotate about its own axis; and a cutter for cutting the yarns, which is mounted coaxially on said dial and is provided with cutting teeth arranged around its own axis; characterized in that it comprises means for actuating said cutter with a rotary motion about its own axis with a rotation rate which can be diversified from the rotation rate of the needle cylinder.

BRIEF DESCRIPTION OF THE DRAWINGS

Further characteristics and advantages of the invention will become apparent from the description of a preferred but not exclusive embodiment of the machine with cutter actuation device according to the invention, illustrated by way of non-limitative example in the accompanying drawings, wherein.

DESCRIPTION OF THE PREFERRED EMBODIMENTS

Figure 1:
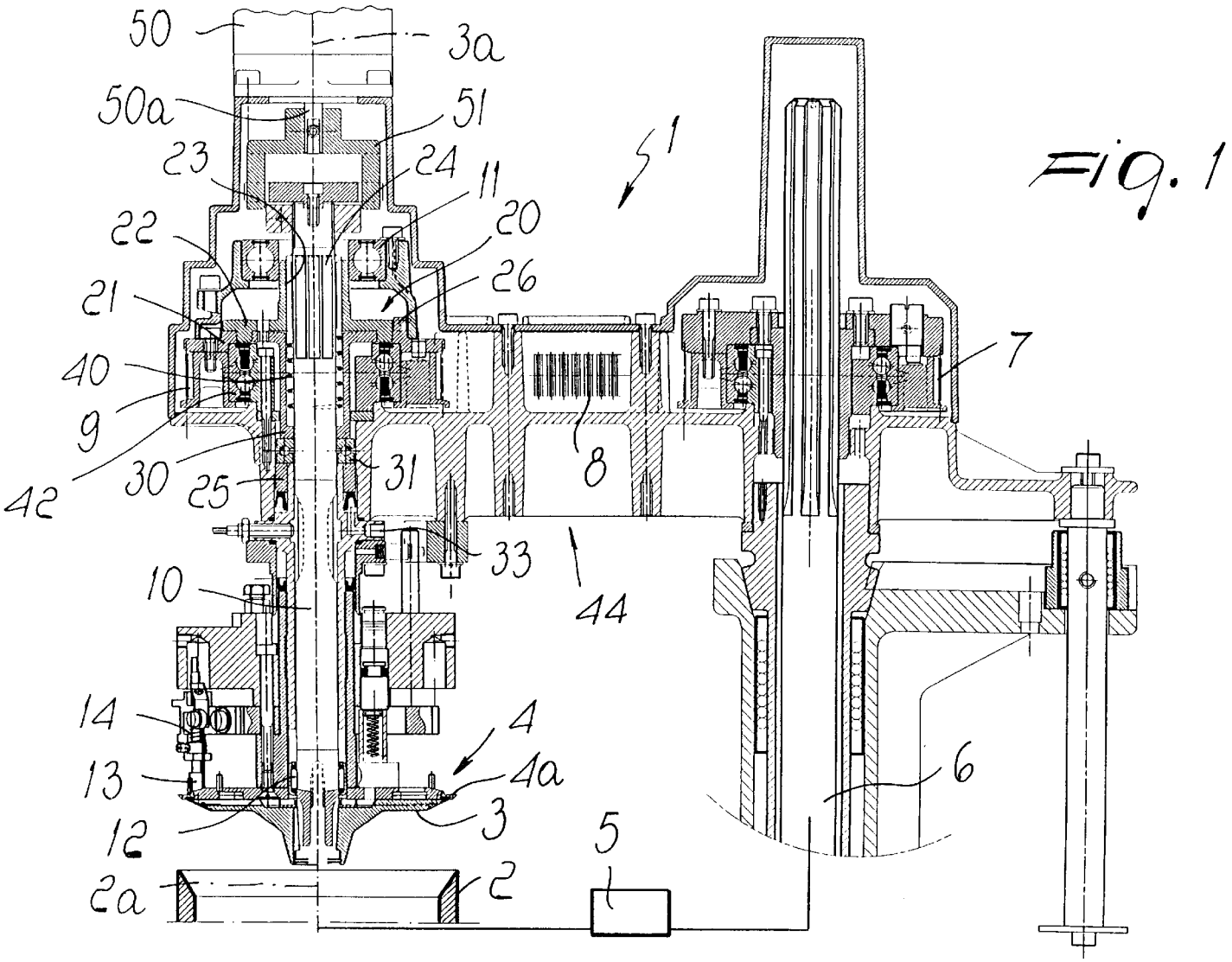
FIG. 1 is a schematic axial sectional view of a single-cylinder circular hosiery knitting machine according to the invention in a first operating condition.

With reference to the above figures, the machine according to the invention, generally designated by the reference numeral 1, comprises, in a per se known manner, a needle cylinder 2 which can be rotationally actuated about its own axis 2*a,* which is substantially vertical, and above which there is a dial 3 which is supported, so that it can rotate about its own axis 3*a,* by a supporting frame 44 which is arranged above the needle cylinder 2.

A cutter 4 is arranged above the dial 3 and coaxially thereto and is provided with cutting teeth 4*a* which are arranged radially around the axis 3*a*.

According to the invention, the machine comprises a device which has means for actuating the cutter 4 with a rotary motion about the axis 3*a* with a rotation rate which can be diversified from the rotation rate of the needle cylinder 2.

More particularly, the needle cylinder 2 is actuated, so as to rotate about its own axis 2*a,* by a motor 5 which is usually arranged inside the footing of the machine.

The motor 5 is connected not only to the needle cylinder 2 but also to a splined shaft 6 which is arranged so that its axis is parallel to the axis 2*a* of the needle cylinder 2. A toothed pulley 7 is mounted on the splined shaft 6, is rigidly coupled to said splined shaft 6 in its rotation about its own axis, and is slideable axially along said splined shaft 6. The toothed pulley 7 is connected, by means of a toothed belt 8, to a toothed pulley 9 which is mounted coaxially around a dial shaft 10, the axis whereof coincides with the axis 3*a* and which supports, so as to rotate rigidly about the axis 3*a,* the dial 3 at its lower end.

The frame 44 supports the dial shaft 10 so that it can rotate about its own axis 3*a,* for example by interposing adapted bearings 11 and 12.

The frame 44 also supports, proximate to the dial 3, a blade 13 which is pushed against the upper face of the cutter 4, proximate to the teeth 4*a,* by a spring 14.

The cutter 4 is conveniently fixed to the dial 3, and the means for actuating the cutter with a rotary motion about the axis 3*a* are substantially constituted by the same means that actuate the dial 3 about the same axis 3*a*.

The means for actuating the dial 3 comprise first means for actuating the dial 3 with a rotary motion about its own axis 3*a* at a rate which is synchronized with the rotation rate of the needle cylinder 2 and second means for actuating the dial 3 with a rotary motion about its own axis 3*a* and at a rate which can be diversified from the rotation rate of the needle cylinder 2. The machine according to the invention also comprises means for deactivating said first actuation means.

The first actuation means of the dial 3 comprise the motor 5, the splined shaft 6, and a mechanical transmission which connects the splined shaft 6 to the motor 5, i.e., the toothed pulley 7, the toothed belt 8 and the toothed pulley 9.

The means for deactivating the first actuation means comprise a clutch coupling, generally designated by the reference numeral 20, which is interposed between said transmission and the dial 3.

More particularly, said clutch coupling 20 comprises a first coupling part 21, which is rigidly coupled to the toothed pulley 9, and a second coupling part 22, which is mounted around the dial shaft 10 and rotates rigidly therewith about its axis. The second coupling part 22 in fact has a through hole 23 which has a slotted profile and couples to a splined portion 24 of the dial shaft 10. The means for deactivating the first actuation means comprise a pusher 25 which acts on the second coupling part 22 to make it slide axially along the dial shaft 10 from an activation position, in which the second coupling part 22 is coupled to the first coupling part 21, so as to rotationally associate the toothed pulley 9 with the dial shaft 10, to a deactivation position, in which the second coupling part 22 is disengaged from the first coupling part 21.

The connection between the first coupling part 21 and the second coupling part 22 is such as to resynchronize the angular position of the dial 3 with respect to the angular position of the needle cylinder 2 when the clutch coupling 20 is activated.

More particularly, the first coupling part 21 has, in a given angular position with respect to the axis 3*a,* a tooth 26 which protrudes axially toward the second coupling part 22 and can be coupled to a seat 27 which is correspondingly formed inside the second coupling part 22. The presence of a single tooth 26 which is capable of coupling exclusively to a single seat 27 formed in the second coupling part 22 ensures the perfect mutual synchronization of the dial 3 and of the needle cylinder 2 when the two coupling parts are mated.

The pusher 25 is constituted by a piston, conveniently a piston with an axial through hole to allow the passage of the dial shaft 10, which is slidingly accommodated inside the chamber 28 of a fluid-actuated cylinder, which is formed between a portion of the frame 44 and the dial shaft 10. A spacer 30 and a thrust bearing 31 are interposed between the pusher 25 and the second coupling part 22, so that the spacer 30, the second coupling part 22 and the dial shaft 10 can rotate about the axis 3*a* with respect to the frame 44 and the pusher 25. The chamber 28 is fed with a pressurized fluid or connected to the discharge through an adapted port 33 formed in the frame 44 to produce the sliding, in one direction or the other, of the pusher 25 along the chamber 28.

The sliding motion of the pusher 25 along the dial shaft 10, in the direction that causes the disengagement of the second coupling part 22 from the first coupling part 21, is contrasted elastically by a spring 40 which is interposed between a shoulder of the shaft 10 and a shoulder of the spacer 30.

The second means for actuating the dial 3 and therefore the cutter 4 with a rotary motion about the axis 3*a* are constituted by an independent motor 50, preferably a variable-speed electric motor, which is connected, by means of its output shaft 50*a,* to the upper end of the dial shaft 10 by means of an adapted coupling 51.

For the sake of completeness in description, it is noted that the dial 9 is supported, so that it can rotate about the axis 3*a,* by the frame 44 by means of an adapted bearing 42.

The frame 44 can also move, in a per se known manner, in a direction which is parallel to the axis 3*a* with respect to the needle cylinder 2 to allow to raise or lower the dial 3 according to the requirements.

The operation of the single-cylinder circular machine with the cutter actuation device according to the invention is as follows.

During normal operation, the dial 3 and therefore the cutter 4 are actuated with a rotary motion about the axis 3*a* at a rate which is synchronized with the rotation rate of the needle cylinder 2 by means of the connection ensured by the mating of the first coupling part 21 with the second coupling part 22. In this condition the motor 5, which actuates the needle cylinder 2, in fact also actuates the dial 3 by means of the transmission constituted by the splined shaft 6, the toothed pulley 7, the toothed belt 8 and the toothed pulley 9 (FIG. 1).

During knitting which requires cutting the yarn, after the last needle of the needle cylinder 2 has taken up the yarn that must subsequently be cut, the yarn is engaged by a tooth 4*a* of the cutter 4 and is gradually moved toward the blade 13. If the cut yarn must have a trailing portion which is substantially as long as obtainable with conventional machines, the second coupling part 22 is kept mated with the first coupling part 21 and thus the dial 3, with the cutter 4, rotates at the same angular velocity as the needle cylinder 2.

Figure 2:
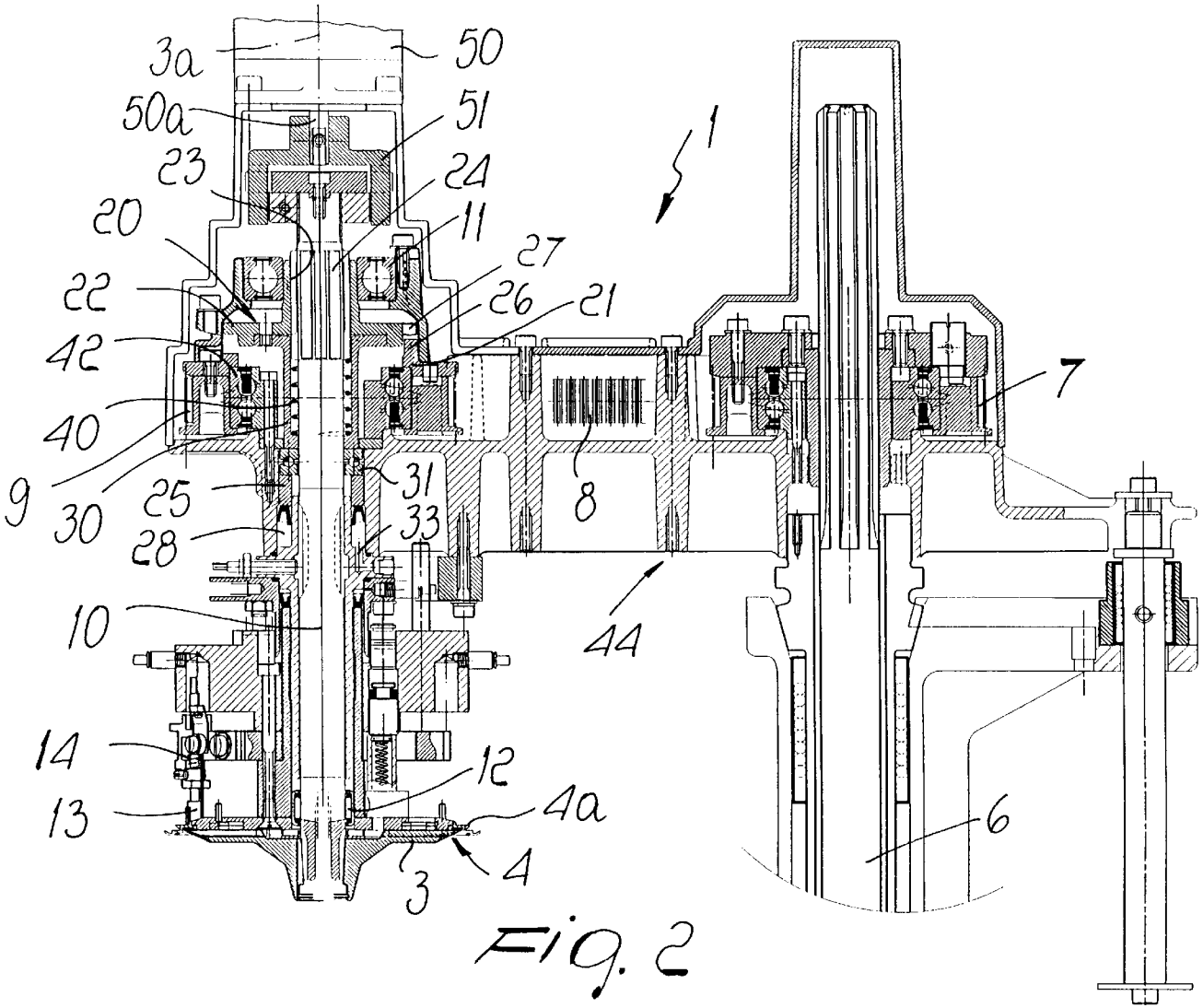
FIG. 2 is a schematic axial sectional view of the machine of FIG. 1 in a second operating condition.

If instead the length of the trailing portion of the yarn that is cut is to be increased, a pressurized fluid is dispensed through the port 33 so as to push upwards, by means of the pusher 25, the second coupling part 22 so as to disengage it from the first coupling part 21 (FIG. 2). In this manner, the dial shaft 10 is disengaged from the connection to the splined shaft 6. At this point, the motor 50 is actuated so as to actuate the dial shaft 10 at a higher rotation rate than the needle cylinder 2. In this manner the yarn engaged by a tooth 4*a* of the cutter 4 is pulled faster than the rate at which the last needle that engaged said yarn advances toward the blade 13. This fact produces a takeup of the yarn through the yarn finger and thus increases the length of the trailing portion of yarn, which is then cut at the blade 13. In this manner a longer yarn trailing portion is obtained than that obtainable if the dial 3 is actuated at the same rotation rate as the needle cylinder 2. By varying the actuation rate of the motor 50, the length of the trailing portion of the cut yarn also varies.

In practice it has been observed that the machine with the cutter actuation device according to the invention fully achieves the intended aim, since it allows, according to the requirements and to the knitting being formed on the machine, to vary the length of the trailing portion of the yarn that is cut by the cutter. In this manner, in a same item, according to the degree of weave of the yarn to be cut, it is possible to vary the length of the trailing portion of said yarn in order to achieve adequate safety against yarn laddering and, at the same time, a length which is not unaesthetic, does not cause discomfort to the user and avoids overlap of nearby pattern yarns.

Another advantage is that it is possible to stop the cutter and the dial when the dial is not required, such as for example during the knitting of the heel in hosiery production, thus also reducing the associated friction and wear.

The machine with the device for actuating the cutter mounted on the dial thus conceived is susceptible of numerous modifications and variations, all of which are within the scope of the inventive concept; all the details may furthermore be replaced with other technically equivalent elements.

The disclosures in Italian Patent Application No. MI97A001733 from which this application claims priority is incorporated herein by reference.

In practice, the materials used, as well as the dimensions, may be any according to the requirements and the state of the art.

What is claimed is:

1. A single-cylinder circular knitting machine comprising:

a needle cylinder, which is rotationally actuatable about an axis thereof;

a dial, which is arranged above the needle cylinder and is supported so as to be rotatable about an axis thereof;

a cutter for cutting the yarns, which is mounted coaxially on said dial and is provided with cutting teeth arranged around an axis thereof; and an actuation device for actuating said cutter with a rotary motion about the mutually coinciding axes of said dial and said cutter with a rotation rate which can be diversified from a rotation rate of the needle cylinder.

2. The machine of claim 1, wherein said cutter is fixed to said dial for rotating together with said dial, and wherein said actuation device comprises:

a first motor for rotating said needle cylinder;

a coupling for selectively connecting said dial and said cutter fixed thereto to said first motor such that said dial and said cutter fixed thereto rotate in synchronization with said needle cylinder; and a second motor for independently rotating said dial and said cutter fixed thereto with a selective rotation speed when said coupling is selectively disconnected between said first motor and said dial and said cutter fixed thereto.

3. The machine of claim 2, wherein said coupling comprises a clutch mechanism.

4. A single-cylinder circular knitting machine comprising:

a needle cylinder, which is rotationally actuatable about an axis thereof;

a dial, which is arranged above the needle cylinder and is supported so as to be rotatable about an axis thereof;

a cutter for cutting the yarns, which is mounted coaxially on said dial and is provided with cutting teeth arranged around an axis thereof;

a cutter actuation means for actuating said cutter with a rotary motion about the axis thereof with a rotation rate which can be diversified from a rotation rate of the needle cylinder;

said cutter being fixed to said dial and said cutter actuation means acting on said dial so as to actuate said dial with a rotary motion about the axis thereof at said diversified rotation rate.

5. The machine of claim 4, further comprising:

a dial shaft with an axis;

first actuation means of said cutter actuation means for actuating the dial with a rotary motion on said dial shaft about the axis thereof at a rate which is synchronized with the rotation rate of the needle cylinder;

second actuation means of said cutter actuation means for actuating the dial with a rotary motion about the axis thereof; and deactivation means for selectively deactivating said first actuation means.

6. The machine of claim 5, wherein said first actuation means comprise:

a mechanical transmission; and an actuation motor of said needle cylinder connected by said transmission to said dial;

and wherein said means for deactivating said first actuation means comprise a clutch coupling which is interposed between said mechanical transmission and said dial, said clutch coupling allowing activation, and respectively deactivation, on command.

7. The machine of claim 6, wherein said clutch coupling is actuatable to resynchronize an angular position of said dial with respect to an angular position of said needle cylinder when said clutch coupling is activated.

8. The machine of claim 2, further comprising a frame, and wherein said dial is supported by said frame so as to be rotatable about the axis thereof, said second actuation means comprising an independent motor and an output shaft thereof, said independent motor being mounted on said frame and being connected to said dial through said output shaft thereof.

9. The machine of claim 4, wherein said independent motor is a variable-speed electric motor.

10. The machine of claim 4, wherein said mechanical transmission comprises: a toothed belt which is connected to said actuation motor; and a toothed pulley meshing with said toothed belt, said pulley being supported for rotation about the dial shaft which coaxially supports said dial;

and wherein said clutch coupling comprises a first coupling part fixed to said toothed pulley and a second coupling part mounted around said dial shaft and being rigidly coupled thereto for rotation about the axis thereof;

and wherein said deactivation means comprise a pusher means acting on said second coupling part to determine axial sliding thereof along said dial shaft from an activation position, in which said second coupling part is mated with said first coupling part in order to rotationally associate said toothed pulley with said dial shaft, to a deactivation position, in which said second coupling part is disengaged from said first coupling part.

11. The machine of claim 10, wherein said first coupling part comprises a tooth arranged in a preset angular position about the axis of said dial shaft, said tooth protruding in an axial direction on a side of said first coupling part which is directed towards said second coupling part; and wherein said second coupling part comprises a seat, said tooth being engageable, as a consequence of an axial movement of said second coupling part along said dial shaft, with said seat.

12. The machine of claim 10, further comprising elastic return means for providing contrasting action of said pusher means, and wherein said pusher means comprises a fluid-actuated cylinder accommodated in said frame and a piston movable inside said cylinder, said piston acting on said second coupling part to produce movement along said dial shaft in a direction providing disengagement from said first coupling part in contrast with the action of the elastic return means.

13. The machine of claim 12, wherein said fluid-actuated cylinder has a piston which is provided with an axial hole, said axial hole of said piston being arranged around said dial shaft.

14. The machine of claim 4, wherein said frame supporting said dial is movable, with respect to the needle cylinder, along a direction which is parallel to the axis of said dial.

15. The machine of claim 4, wherein said cutter actuation means comprises:

a first motor for rotating said needle cylinder;

a coupling for selectively connecting said dial and said cutter fixed thereto to said first motor such that said dial and said cutter fixed thereto rotate in synchronization with said needle cylinder; and a second motor for independently rotating said dial and said cutter fixed thereto with a selective rotation speed when said coupling is selectively disconnected between said first motor and said dial and said cutter fixed thereto.

16. The machine of claim 15, wherein said coupling comprises a clutch mechanism.

* * * * *